US005697595A

United States Patent [19]

Sperber

[11] Patent Number: 5,697,595

[45] Date of Patent: Dec. 16, 1997

[54] FLIP CHART

[75] Inventor: Georg Sperber, Bad Lippspringe, Germany

[73] Assignee: P & i Produkform und Industrietechnik GmbH, Bad Lippspringe, Germany

[21] Appl. No.: 553,626

[22] PCT Filed: Mar. 28, 1995

[86] PCT No.: PCT/EP95/01151

§ 371 Date: Dec. 5, 1995

§ 102(e) Date: Dec. 5, 1995

[87] PCT Pub. No.: WO95/27421

PCT Pub. Date: Oct. 19, 1995

[30] Foreign Application Priority Data

Apr. 9, 1994 [DE] Germany ..... 94 05 926 U

[51] Int. Cl.[6] ..... A47B 97/04

[52] U.S. Cl. ..... 248/452; 248/125.1

[58] Field of Search ..... 248/452, 125.1, 248/125.3, 122.1, 129, 132, 161, 157; 40/606, 607

[56] References Cited

U.S. PATENT DOCUMENTS

| | | | |
|---|---|---|---|
| 2,959,886 | 11/1960 | Lopez | 45/80 |
| 3,809,354 | 5/1974 | Phifer | 248/452 |
| 3,980,267 | 9/1976 | Palmer | 248/455 |
| 4,456,286 | 6/1984 | Jamar | 248/452 |

FOREIGN PATENT DOCUMENTS

| | | |
|---|---|---|
| 1 272 106 | 1/1962 | France . |
| 42 21 637 | 1/1994 | Germany . |

*Primary Examiner*—Leslie A. Braun
*Assistant Examiner*—Willie Berry, Jr.
*Attorney, Agent, or Firm*—Browdy and Neimark

[57] ABSTRACT

The flip chart has a panel (2) which is held on a vertical guide and can smoothly slide vertically and serves as a clipboard for single or multiple pages or as a writing board. The vertical guide is constituted by a central column (4) supported on a rolling base (3) which can be detached from the rolling base (3) along with the panel (2), and can be suspended on a wall rail (6) by means of rollers (5), can be slid laterally with the panel (2), and which additionally holds the panel (2) so that it can slide vertically.

16 Claims, 6 Drawing Sheets

FLIP CHART

Figure 1:
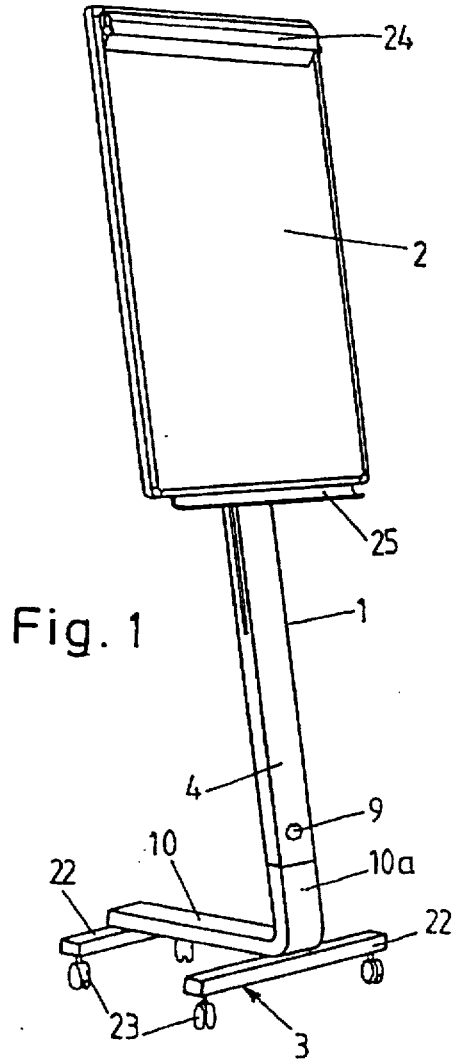

The invention relates to a flip chart with a panel which is held on a vertical guide and can be smoothly adjusted vertically which serves as a writing board or a clipboard for single and multiple pages.

German published, unexamined patent application DE-OS 42 21 637 discloses a flip chart embodied in this way, which constitutes a stand and in which the panel is supported so it can slide vertically as a vertical guide on a stand which is embodied like a tripod.

Based on this prior art, the object is to create a variable flip chart, embodied as a mobile stand and a hangable chalkboard-like panel, which is easy to convert into the respective functions, which is convenient to adjust both vertically and laterally, and which can be folded up in a space-saving manner.

This object is attained according to the invention in that the vertical guide is constituted by a central column which is supported on a rolling base and which can be detached along with the panel from the rolling base and can be suspended on a wall rail by means of rollers and can be slid laterally with the panel and additionally holds the panel so that it can slide vertically.

Another preferred embodiment form is to make the panel on the column detachable and to hang it so that it can slide laterally on a wall rail by means of rollers.

The flip chart according to the invention is composed of an upright column which is carried on a rolling base and can be easily tilted back and up, and a panel which can smoothly slide in a limited vertical range on this column and which on the one hand holds single and multiple pages with a clamp rail on the top and on the other hand can be embodied as a writing board.

This flip chart with a rolling base on the one hand constitutes a mobile stand with which the user can conveniently adjust the panel to the respectively desired vertical position and with which the observer can get a good view of the panel.

Furthermore, the column is detachably fastened to a bar piece of the rolling base in an advantageous way so that the column with the panel can be detached from the rolling base and used as a wall flip chart; on the back of the column, rollers on a rail are provided for this purpose, with which the column with the panel can be suspended from a horizontal wall rail so that the column with the panel can then slide horizontally and the panel can slide vertically on the column.

In another advantageous embodiment, the panel can be detached from the column and, using rollers on its back, can be suspended on a wall rail so that the panel alone can be slid laterally on this wall rail.

This embodiment of the flip chart can be used in various ways and can alternatively be used according to the respective conditions.

In addition, this detachable embodiment of column and rolling base as well as panel and column permits the flip chart to fold up in a space-saving way for transport to each site where it is to be used.

The panel is supported on the column with convenient sliding or rolling guides so that it can smoothly slide vertically and a cable pull with a counterweight or a gas spring is inserted between column and panel to balance the weight, which permits the user to slide it vertically in an easy and energy-saving manner.

In addition, the ease with which the panel slides vertically can be varied using adjustable clamping means.

Furthermore, a cantilevered arm with two support pins which can be adjusted horizontally and vertically can be fixed to the column in a detachable and/or a vertically adjustable way so that when the column has no panel, a board can be placed on these support pins by means of which the flip chart can be used as an easel or vertically adjustable tripod.

The drawings show an exemplary embodiment of the invention, which is explained below.

Figure 10:
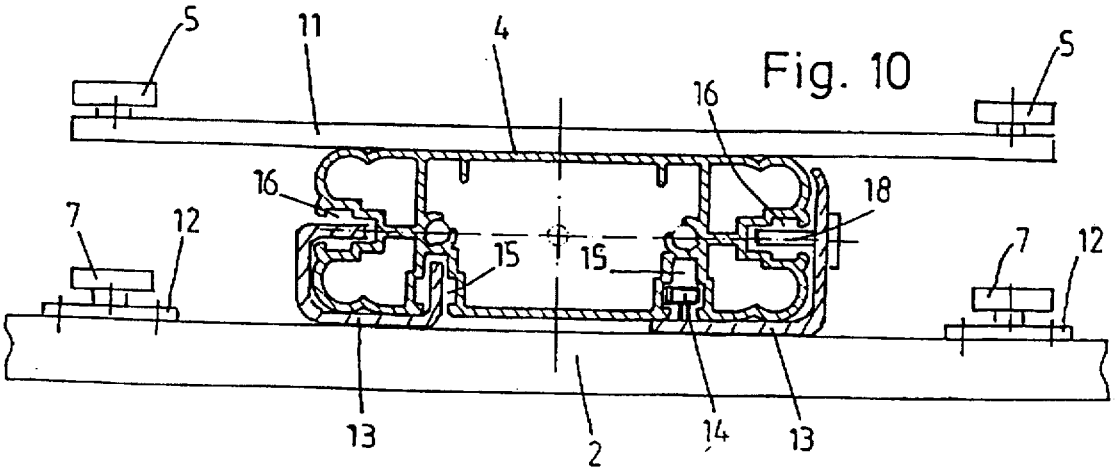
Figure 3:
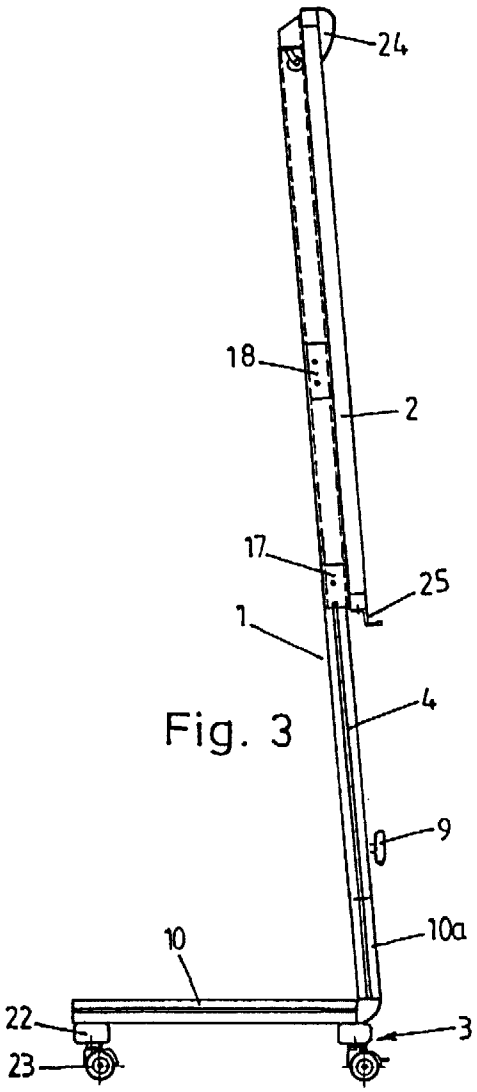
Figure 2:
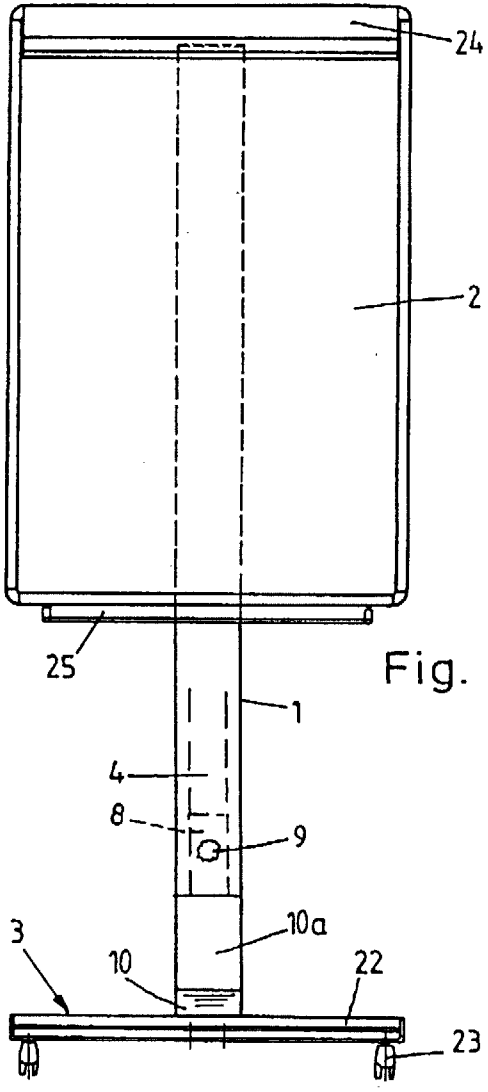
Figure 7:
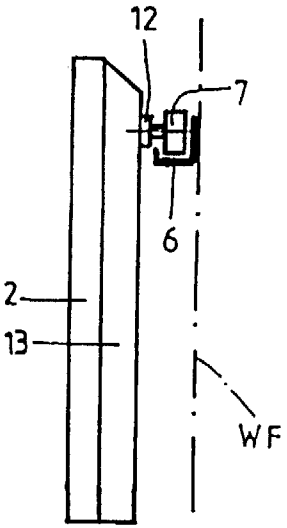
Figure 6:
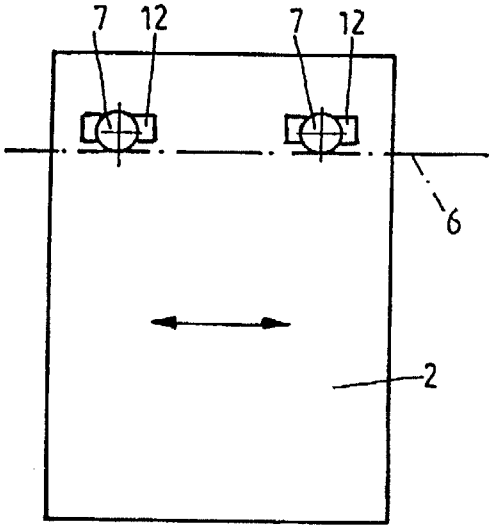
Figure 5:
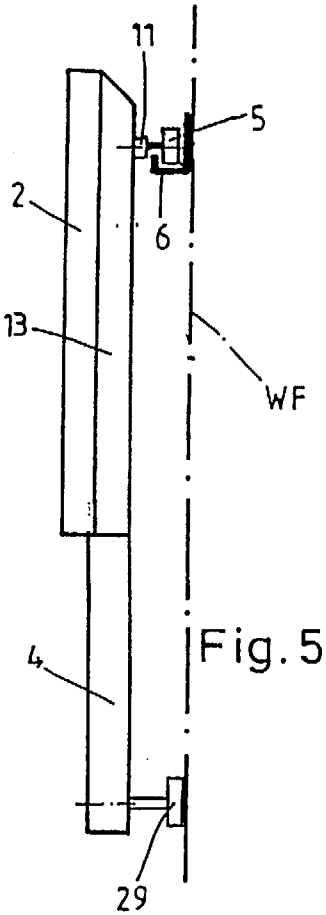
Figure 4:
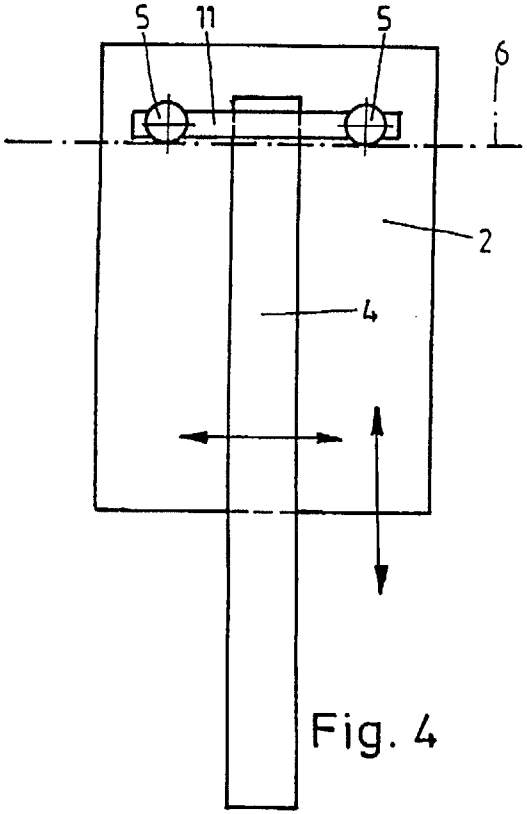
Figure 8:
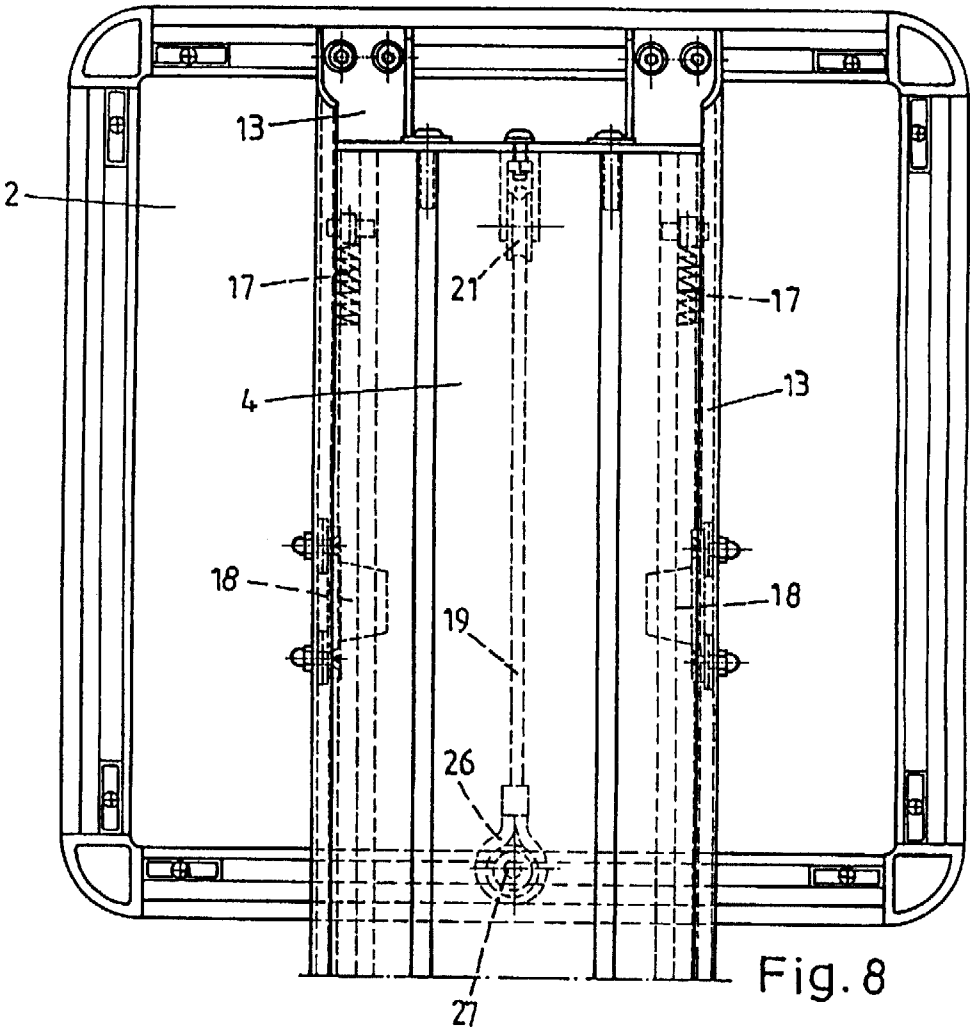
Figure 9:
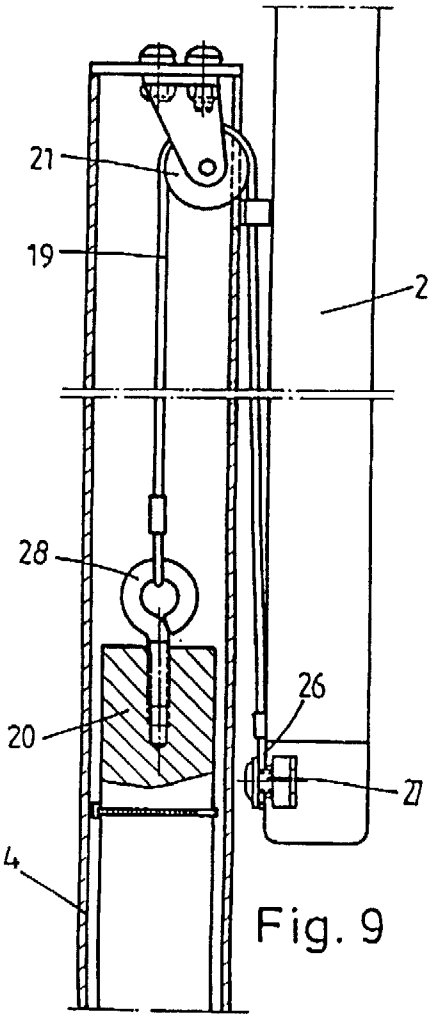
Figure 11:
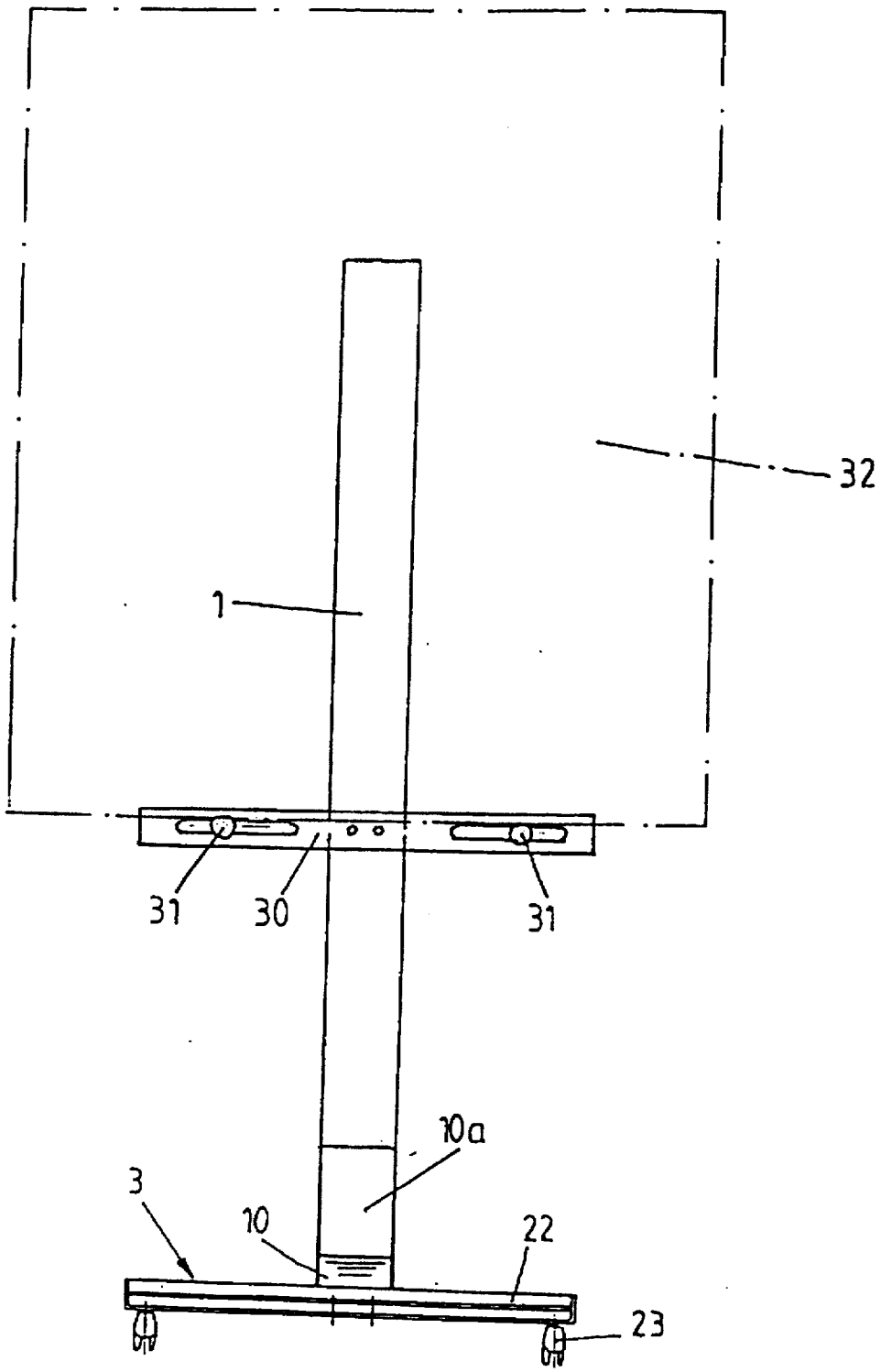

FIG. 1 shows a perspective of a flip chart embodied as a stand, which is constituted by a central, upright column which is carried by a rolling base and a panel held on it which can slide vertically, FIG. 2 shows a front view of the flip chart with a column which can be ached from the rolling base, FIG. 3 shows a side view of the same flip chart, FIG. 4 shows a schematic rear view of the column with a panel when detached from the rolling base in an embodiment which is suspended on a wall rail as a flip chart which can be moved laterally and vertically, FIG. 5 shows a schematic side view of the suspended flip chart according to FIG. 4, FIG. 6 shows a schematic side view of the panel which is detached from the column, suspended on a wall rail, and can slide laterally, FIG. 7 shows a schematic side view of the suspended panel according to FIG. 6, FIG. 8 shows a rear view of the column with the panel and with guidance, damping, and weight balancing, FIG. 9 shows a longitudinal section through the column and the panel held on it in weight equilibrium way by a cable pull and a counterweight, FIG. 10 shows a cross section through the column with the panel and rollers for hanging on a wall rail, which are installed on the column and panel, with a slide rail guide shown in the left half of the drawing and a rolling guide shown in the right half of the drawing, and means for adjusting the displaceability of the panel on the column, FIG. 11 shows a front view of the column with a cantilevered arm and support pins for a board.

Figure 12:
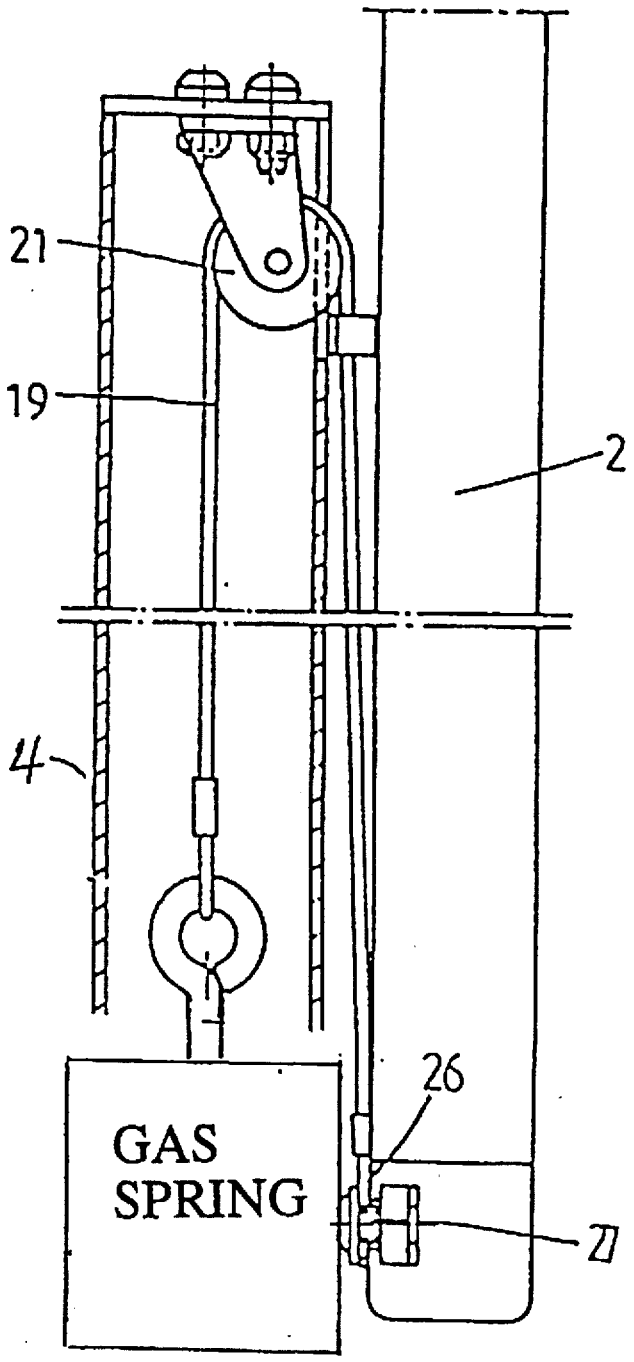

FIG. 12 shows a gas spring.

The flip chart has a panel (2) which is held on a vertical guide (1), can be smoothly adjusted vertically, and serves as a clipboard for single or multiple pages or as a writing board. The vertical guide (1) is constituted by a central column (4) supported on a rolling base (3), which can be detached from the rolling base (3) along with the panel (2), can be suspended on a wall rail (6) by means of rollers (5), and can slide laterally with the panel (2) and additionally holds the panel (2) so that it can slide vertically (FIGS. 4 and 5).

FIGS. 5 and 7 use dot-dash lines to show the wall surface (WF) on which the wall rail (6) is fastened.

Furthermore, the panel (2) is detachably held on the column (4) and can be suspended on a wall rail (6) by means of rollers (7) so that it can slide laterally.

The column (4) can be detachably held with its bottom end in an upright bar piece (10*a*) of the rolling base (3) by means of plug-in connection (8) and securing means (9); as shown in FIG. 2, the column (4) fits with its bottom end over a fitting (8) of the rolling base bar piece (10*a*), and the plug-in connection is secured by a hand screw (9).

There is also the possibility of detachably connecting the column (4) by plug/detent connection to the rolling base bar piece (10*a*).

In the upper back region, the column (4) has a horizontal rail (11) fastened on it on which at least two rollers (5) are rotatably supported, which can be suspended in/via the wall rail (6).

In the upper back region, on holders (12), the panel (2) has one rotatably supported roller (7) on each of the two sides of the column (4); these rollers can be suspended in/via the wall rail (6).

The column (4) is constituted by a profile, preferably an aluminum profile, and the panel (2) is supported so that it can slide vertically with slide rails (13) and/or rollers (14) in profile grooves (15, 16) of the column (4) and is braked in the two vertical adjustment end positions by damping springs (17) disposed on top and bottom in the profile grooves (15, 16) and its ability to slide can be adjusted by means of adjustable clamping means (18), such as eccentric elements, wedges, or the like enclosed in the profile grooves (15, 16).

The right half of FIG. 10 shows a slide rail (13) which is fastened to the panel (2) and using rollers (14), engages in the profile grooves (15) of the column (4) for sliding the panel, and grasps in a second profile groove (16) with a clamping means (18) to make the panel (2) work easily.

The left half of FIG. 10 shows the slide rail (13) which is fastened to the panel (2) and grasps in both profile grooves (15, 16) of the column (4) to guide the panel.

Furthermore, the panel (2) is held on the column (4) via a cable pull (19) and a counterweight (20) so that it is weight-balanced and can smoothly slide vertically; the cable pull (19) is fastened with one end (eye 26 and screw 27) to the panel (2), deflected via a deflection pulley (21) in the column (4), and with its other end, it is connected by an eyelet bolt (28) to the counterweight (20) which can be raised and lowered in the column (4).

In a further embodiment, the panel (2) can be held by a gas compression spring in a weight-balanced manner and such that it can slide vertically in relation to the column (4).

The rolling base (3) is comprised of an angled bar (10) which constitutes the upright bar piece (10*a*) for the connection with the column (4), two cross bars (22) which carry this angled bar (10), and four rollers (23) which are controllably supported on the cross bars (22) and some of which are lockable.

There is a horizontal paper clamping rail (24) on the top of the panel (2) and a horizontal tray (25) on the bottom for writing utensils or the like.

The panel (2) can be detached from the column (1) by sliding upward or by pivoting forward in relation to the column (1).

As FIG. 5 shows, in its bottom end region on the back, the column (1) is equipped with a spacer (29) with which the column (1) with the panel (2), which is suspended on the wall rail (6), is supported on the wall surface (WF) in a positionally stable manner.

According to FIG. 11, the column (1) without a panel (2) is alternatively equipped on the front with a fixed and/or vertically adjustable and detachable cantilevered arm (30) which has support pins (31) which can be adjusted horizontally and vertically (spaced apart from each other), upon which a board (32) which rests against the column (1) can be loosely stood up; here, the column (1) with a board (32) constitutes an easel or the column (1) constitutes a vertically adjustable tripod for a board (32).

I claim:

1. A flip chart comprising a panel (2);

a vertical guide comprising a central column (4); and slide means for the panel to be held and smoothly adjusted vertically along the guide for use of the panel as a clipboard for single or multiple pages or as a writing board, the slide means comprising:

the column (4) comprising a profile including profile grooves (15, 16);

the panel (2) comprising means to engage in an adjustable manner with the profile grooves (15, 16), said means to engage including at least one of slide rails (13) and first rollers (14);

braking means disposed in two vertical adjustment end positions, the braking means including damping springs (17) disposed in top and bottom ends of the profile grooves (15, 16); and adjustable clamping means (18), enclosed in the profile grooves (15, 16), for holding the panel (2) relative to the column (4).

2. The flip chart according to claim 1, characterized in that a horizontal rail (3) is fastened to the column (4) in the upper back region, on which horizontal rail at least two rollers (5) are rotatably supported, comprising means to be suspended in/via the wall rail (6).

3. The flip chart according to claim 1, characterized in that the panel (2) is held on the column (4) via a cable pull (19) and a counterweight (20) so that it is weight-balanced and smoothly slidable vertically, wherein the cable pull (19) is fastened with one end to the panel (2), deflected via a deflection pulley (21) in the column (4), and with its other end, is connected to the counterweight (20) comprising means to be raised and lowered in the column (4).

4. The flip chart according to claim 1, characterized in that the panel (2) is held in a weight counterbalanced manner by means of a gas spring comprising means to slide vertically in relation to the column (4).

5. The flip chart according to claim 1, characterized in that a horizontal paper clamping rail (24) is disposed on the top of the panel (2) and a horizontal tray (25) is disposed on the bottom of the panel.

6. The flip chart according to claim 1, characterized in that in a bottom end region on a back thereof, the column (1) has a spacer (29) which fixes the position of the column (1) suspended with the panel (2) on the wall rail (6) in relation to the wall surface (WF).

7. The flip chart according to claim 1, characterized in that on a front thereof, the column (1) includes a vertically slidable and detachable cantilevered arm (30) with adjustable support pins (31) for a board (32).

8. The flip chart according to claim 7, wherein the cantilevered arm (30) is fixed.

9. The flip chart according to claim 1, including a rolling base (3) and a wall rail (6);

means for supporting the central column (4) on rolling base (3);

means for detaching the central column (4) along with the panel (2) from the rolling base (3), suspending the central column (4) on the wall rail (6) by means of third rollers (5), such that the panel (2) can slide both laterally and vertically.

10. The flip chart according to claim 1, wherein the profile includes aluminum.

11. The flip chart according to claim 1, wherein the adjustable clamping means includes at least one of eccentrics and wedges.

12. A flip chart comprising a panel (2);

a vertical guide comprising a central column (4);

slide means for the panel to be held and smoothly adjusted vertically along the guide for use of the panel as a clipboard for single or multiple pages or as a writing board;

a rolling base (3) and a wall rail (6);

means for supporting the central column (4) on rolling base (3);

means for detaching the central column (4) along with the panel (2) from the rolling base (3), suspending the central column (4) on the wall rail (6) by means of third rollers (5), such that the panel (2) can slide both laterally and vertically; and means for detachably holding the panel (2) on the column (4) and suspending the panel on a wall rail (6) by means of second rollers (7) for the panel to slide laterally;

the panel (2) including one rotatably supported roller (7) each, on holders (12), on both sides of the column (4), in an upper back region, and means for the rollers to be supported via the wall rail (6).

13. A flip chart comprising a panel (2);

a vertical guide comprising a central column (4);

slide means for the panel to be held and smoothly adjusted vertically along the guide for use of the panel as a clipboard for single or multiple pages or as a writing board;

a rolling base (3) and a wall rail (6);

means for supporting the central column (4) on rolling base (3); and means for detaching the central column (4) along with the panel (2) from the rolling base (3), suspending the central column (4) on the wall rail (6) by means of third rollers (5), such that the panel (2) can slide both laterally and vertically; wherein plug-in connection (8) and retaining means (9) for detachably holding the column (4) with a bottom end thereof in an upright bar piece (10) of the rolling base (3); wherein the rolling base (3) includes an angled bar (10) comprising the upright bar piece (10*a*) for the detachable connection bar (10), and four rollers (23) comprising means for controllably supporting the cross bars (22) and at least one of the rollers being lockable.

14. A flip chart comprising a panel (2);

a vertical guide comprising a central column (4);

slide means for the panel to be held and smoothly adjusted vertically along the guide for use of the panel as a clipboard for single or multiple pages or as a writing board;

a rolling base (3) and a wall rail (6);

means for supporting the central column (4) on rolling base (3); and means for detaching the central column (4) along with the panel (2) from the rolling base (3), suspending the central column (4) on the wall rail (6) by means of third rollers (5), such that the panel (2) can slide both laterally and vertically; wherein the panel (2) is held on the column (4) via a cable pull (19) and a counterweight (20) so that it is weight-balanced and smoothly slidable vertically, wherein the cable pull (19) is fastened with one end to the panel (2), deflected via a deflection pulley (21) in the column (4), and with its other end, is connected to the counterweight (20) comprising means to be raised and lowered in the column (4).

15. A flip chart comprising a panel (2);

a vertical guide comprising a central column (4);

slide means for the panel to be held and smoothly adjusted vertically along the guide for use of the panel as a clipboard for single or multiple pages or as a writing board;

a rolling base (3) and a wall rail (6);

means for supporting the central column (4) on rolling base (3); and means for detaching the central column (4) along with the panel (2) from the rolling base (3), suspending the central column (4) on the wall rail (6) by means of third rollers (5), such that the panel (2) can slide both laterally and vertically; wherein the panel (2) is held in a weight counterbalanced manner by means of a gas spring comprising means to slide vertically in relation to the column (4).

16. A flip chart comprising a panel (2);

a vertical guide comprising a central column (4);

slide means for the panel to be held and smoothly adjusted vertically along the guide for use of the panel as a clipboard for single or multiple pages or as a writing board;

a rolling base (3) and a wall rail (6);

means for supporting the central column (4) on rolling base (3); and means for detaching the central column (4) along with the panel (2) from the rolling base (3), suspending the central column (4) on the wall rail (6) by means of third rollers (5), such that the panel (2) can slide both laterally and vertically; wherein in a bottom end region on a back thereof, the column (1) has a spacer (29) which fixes the position of the column (1) suspended with the panel (2) on the wall rail (6) in relation to the wall surface (WF).

* * * * *